US005971044A

United States Patent [19]

Valentin

[11] Patent Number: 5,971,044

[45] Date of Patent: Oct. 26, 1999

[54] TOOL WITH PARALLEL CORNERS FOR SPLITTING WOOD

[76] Inventor: Hervé Valentin, 8 rue du Maréchal Leclerc, 55200 Vignot, France

[21] Appl. No.: 08/383,214

[22] Filed: Feb. 2, 1995

[51] Int. Cl.[6] ..... B27L 7/00

[52] U.S. Cl. ..... 144/193.1; 144/48.6; 144/366; 74/25; 74/55

[58] Field of Search ..... 144/1 E, 1 F, 1 R, 144/193 R, 194, 193 D, 366; 74/22 A, 25, 53, 55, 56, 89.15, 26

[56] References Cited

U.S. PATENT DOCUMENTS

| | | | |
|---|---|---|---|
| 2,094,640 | 10/1937 | Koster et al. | 144/193 R |
| 3,896,861 | 7/1975 | Heisler | 144/1 E |
| 4,111,060 | 9/1978 | Nerini | 144/1 E |
| 4,176,698 | 12/1979 | Ahlschlager et al. | 144/193 R |
| 4,491,164 | 1/1985 | Waikas et al. | 144/194 |

FOREIGN PATENT DOCUMENTS

| | | |
|---|---|---|
| 2462979 | 2/1981 | France . |

*Primary Examiner*—W. Donald Bray
*Attorney, Agent, or Firm*—Weiser & Associates, P.C.

[57] ABSTRACT

A wood-splitting tool includes at least one system with n parallel elemental wedges (3*a*, 3*b*, 3*c*, . . . 3*n*) which in succession are given a movement for penetrating the wood. The system for actuating the wedges can be a hydraulic, chain-type, connecting rod-type, or percussive-type system attached to a motive power unit.

14 Claims, 1 Drawing Sheet

FIG. 1
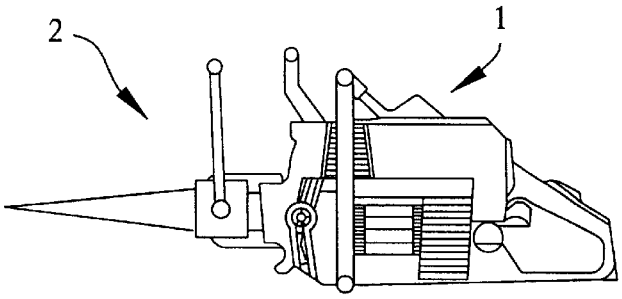
FIG. 2
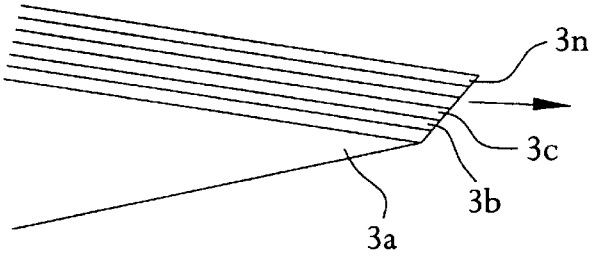
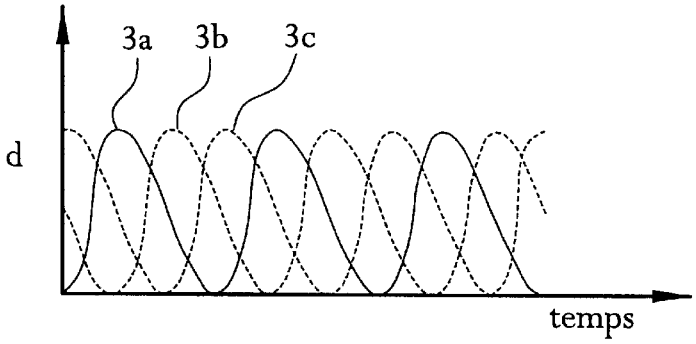
FIG. 3
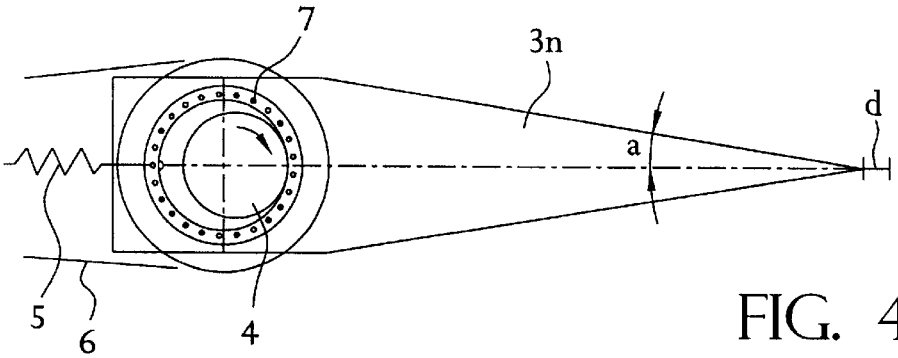
FIG. 4

TOOL WITH PARALLEL CORNERS FOR SPLITTING WOOD

BACKGROUND OF THE INVENTION

The present invention relates to a tool for splitting balks of firewood and to a wood-splitting machine equipped with this tool.

Wooden balks, cut to a length of one meter and a diameter greater than 15–20 cm, are systematically split longitudinally to make it easier to handle them, accelerate subsequent drying, and favor combustion.

In most cases, splitting is carried out manually, with the aid of wedges, weights and cleaving axes. In the remaining cases, splitting is mechanized, either using a tapered screw system, or using a hydraulic wedge system.

For each of these systems, various types of drive may be used. Electric motors have been used, but such use is not very widespread as splitting is not carried out in the forest and performance is mediocre. Steam engines have been used, but such systems have far too high a cost. Systems have been coupled to a "three-point" hitch of a tractor or to its hydraulic take-off, and the performance of such systems are good. However, a powerful tractor is required.

Presently, only owners of agricultural tractors use mechanical splitting machines. Splitting machines using a tapered screw (for example, as described in FR 2 462 979) are the most widespread and least expensive.

It remained desirable to provide a machine of a completely new type, which was directed to the vast majority of users, primarily lumberjacks (amateur or semi-professional), who still split wood manually.

SUMMARY OF THE INVENTION

It is, therefore, an object of the present invention to provide an economical tool for splitting wood that can be used by the general population, including amateurs, semi-professionals, and those who do not own a tractor.

It is also an object of the present invention to provide a tool for splitting wood that is capable of using available portable machines, including steam-powered, motorized saws, as an energy source.

It is also an object of the present invention to provide a tool for splitting wood that is easily adapted to existing machinery and which can provide correct performance, even for difficult (hard and large diameter) wood pieces.

It is also an object of the present invention to provide a tool for splitting wood which is portable and which is low in cost.

These and other objects are achieved in accordance with the present invention by providing a wood-splitting tool, including at least one system having parallel elemental wedges which are successively reciprocated (a forward and backward movement) such that when one wedge advances, the other wedges are kept immobile relative to each other. The tool preferably includes two systems with parallel elemental wedges, mounted symmetrically relative to the axis of symmetry of the tool, such that the elemental wedges advance in pairs.

Furthermore, this tool is adapted to be able to be fitted to any of a variety of portable machines including motorized saws or other types (e.g., power transmitted by means of a chain).

The invention will be better understood with the aid of the description given hereafter and with reference to the following appended figures.

BRIEF DESCRIPTION OF THE DRAWINGS

FIG. 1 is an elevational view of a splitting machine according to the invention.

FIG. 2 is an enlarged, partial plan view of the parallel wedges of the blade.

FIG. 3 is a graph illustrating the movements of the wedges for a system with three parallel wedges.

FIG. 4 is a schematic illustration of a system with parallel wedges.

DETAILED DESCRIPTION OF THE INVENTION

A wood-splitting machine according to the invention includes a motive power unit (1) and a system of parallel wedges (2) which can be fitted onto the motive power unit (1). The parallel wedges (2) are formed of a plurality of elemental wedges (3*a,* 3*b,* 3*c,* . . . 3*n*) able to move parallel to one another in a reciprocating motion (in the direction of penetration into the wood). Such motion takes advantage of the theory of wedge rubbing.

If:

P=force required to drive the wedge into the log

R=force required to extract the wedge a=½ the angle of the wedge f=wedge/wood angle of friction then $$P/R = \frac{\tan(a+f)}{\tan(f+a)}$$

The angle of friction f varies depending on the species and moisture content of the wood, and the speed of movement of the wedge. The angle a results from the geometry of the wedge, and should not be less than a certain value in order to preserve the mechanical strength of the wedge. Experience has shown that the resulting ratio (P/R) varies between 2 and 5.

A preferred system is formed of n parallel wedges which are successively given a movement such that, when one wedge advances, the other n−1 wedges are kept immobile relative to each other. If n−1>P/R, then the system is an automatically-penetrating system.

By way of example, FIG. 3 illustrates the movements of three elemental wedges (3*a,* 3*b,* 3*c*) for n=3. At each point in time, two wedges are kept immobile relative to each other while the third wedge penetrates the wood.

FIG. 4 shows, by way of non-limiting example, a means for coupling the system of parallel wedges (2) to the motive power unit (1) of the motorized saw. In this configuration, the wedges (3*n*) are caused to move by a camshaft (4) driven by a chain (6) of the motorized saw, which meshes with a sprocket (7) for driving the camshaft. The camshaft (4) will have a profile such that in 1/n of a revolution, the corresponding wedge advances by a distance d and, over the remaining (n−1)/n of a revolution the corresponding wedge moves back by the same amount. The n cams (4) will be offset by 1/n of a revolution.

Camshaft/wedge contact is ensured by n independent springs. Reversal of the pressure of the springs (5), for example by means of a lever handle, makes it possible to extract wedges if the log has not been burst open. Rolling-contact bearings ensure that contact between the camshaft and the wedges is frictionless.

The system of wedges previously described can be fitted to any portable motive power unit including a rotary power take-off. Other systems for actuating the wedges are possible, for example hydraulic systems and systems using connecting rods or percussion. The essential feature is that the system includes n parallel wedges which in succession are given a movement for penetrating the wood. The elastic and reversible means for pushing or pulling the wedges are not limited to the shown example. It is also possible, for example, to use a stack of spring washers or Belleville washers, or an elastomer block.

Moreover, the shape, width, and angle of a wedge can be different from the wedges shown without departing from the scope of the invention. The number of wedges is preferably greater than three, and on the order of about ten.

As an alternative embodiment (not shown) the tool can be formed of two symmetric systems of wedges, such that the wedges advance in pairs. The systems of wedges are symmetrically arranged relative to the axis of symmetry of the tool so as to distribute the forces uniformly over each wedge.

The advantages of the present invention are numerous, and in particular include its lightweight nature, ease of fitting, high safety, a splitting operation which is faster, less arduous, and less dangerous than by hand, automatic release (by reversing the system), and satisfactory performance for a modest cost.

I claim:

1. A wood-splitting tool comprising a plurality of parallel wedges capable of forward and rearward movement relative to each other, wherein each of the plurality of parallel wedges has a first end including a cutting edge and a second end for connection with actuating means for separately reciprocating the plurality of parallel wedges.

2. The wood-splitting tool of claim 1 wherein the actuating means is coupled with the plurality of parallel wedges so that when one of the plurality of parallel wedges is advanced in a forward direction, remaining ones of the plurality of parallel wedges are kept immobile.

3. The wood-splitting tool of claim 1 which further includes two cooperating means for advancing the plurality of parallel wedges.

4. The wood-splitting tool of claim 3 wherein the two advancing means are mounted symmetrically relative to the tool.

5. The wood-splitting tool of claim 4 wherein the two advancing means are coupled with the plurality of parallel wedges so that separate wedges are advanced in pairs.

6. The wood-splitting tool of claim 1 which further includes a camshaft for coupling the actuating means with the plurality of parallel wedges.

7. The wood-splitting tool of claim 6 wherein the camshaft includes a plurality of cams having cam profiles for advancing the plurality of parallel wedges during a first portion of a revolution of the camshaft, and for retracting the plurality of parallel wedges by an equal distance during a second, remaining portion of said revolution of the camshaft.

8. The wood-splitting tool of claim 7 which includes n cams, wherein each of the n cams are offset relative to each other by 1/n of said revolution of the camshaft.

9. The wood-splitting tool of claim 6 which further includes a chain for coupling the camshaft with the actuating means.

10. The wood-splitting tool of claim 1 wherein each of the plurality of parallel wedges is separately biased by means for elastically and reversibly moving the wedges relative to one another.

11. The wood-splitting tool of claim 10 wherein the biasing means are a plurality of springs.

12. The wood-splitting tool of claim 10 which further includes an automatic safety release.

13. A wood-splitting apparatus comprised of a portable actuating means and the wood-splitting tool of claim 1.

14. The wood-splitting apparatus of claim 13 wherein the portable actuating means is a motorized saw.

* * * * *